US006532908B1

(12) United States Patent
Wang

(10) Patent No.: US 6,532,908 B1
(45) Date of Patent: Mar. 18, 2003

(54) ENGINE STARTER FOR A REVERSIBLE ENGINE

(76) Inventor: Kuan-Hung Wang, No. 36, Lane 215, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 09/988,619

(22) Filed: Nov. 20, 2001

(51) Int. Cl.[7] ..... F01L 13/02
(52) U.S. Cl. ..... 123/41 E
(58) Field of Search ..... 123/41 E, 179.24, 123/179.25, 185.8; 192/44, 45, 42, 31; 74/7 C

(56) References Cited

U.S. PATENT DOCUMENTS 5,161,489 A * 11/1992 Morooka ..... 123/41 E
5,794,574 A * 8/1998 Bostelmann et al. ..... 123/41 E

* cited by examiner

*Primary Examiner*—Henry C. Yuen
*Assistant Examiner*—Hai H. Huynh
(74) *Attorney, Agent, or Firm*—Fei-Fei Chao; Venable, Baetjer, Howard & Civiletti, LLP

(57) ABSTRACT

An engine starter for a reversible engine includes a drive device rotatably mounted on the reversible engine. The drive device includes a flywheel connected to a motor and a positioning seat selectively attaching the flywheel to the reversible engine. The positioning seat releases from the reversible engine when the reversible engine is started. An ignition device is adapted to be connected to the reversible engine. The ignition device includes a rotor rotated with the reversible engine. A sense member is mounted on an outer periphery of the rotor and a magnetic sensor is separately mounted in close proximity to the sense member and corresponding to the sense member. The sense member is adapted to make the magnetic sensor providing an ignition signal to a spark plug that is mounted on the reversible engine when the rotor rotates.

2 Claims, 11 Drawing Sheets

ENGINE STARTER FOR A REVERSIBLE ENGINE

BACKGROUND OF THE INVENTION

1. Field of the Invention

The present invention relates to a starter, and more particularly to an engine starter for a reversible engine, which starts the reversible engine in either a normal or a reversed direction.

2. Description of Related Art

A conventional engine starter starts an engine that provides power in a specific direction so that the conventional engine needs a clutch and gearbox to change the direction of the output power. Consequently, a conventional engine starter cannot be used with a reversible engine. The disadvantage of the conventional engine starter needs to be overcome.

The present invention has arisen to mitigate and/or obviate the disadvantages of the conventional engine starter.

SUMMARY OF THE INVENTION

The main objective of the present invention is to provide an improved engine starter that starts a reversible engine no matter whether the reversible engine is to be rotated in a normal or a reversed direction.

To achieve the objective, the engine starter in accordance with the present invention comprises a drive device adapted to rotatably mount on the reversible engine. The drive device includes a flywheel adapted to connect to a motor and a positioning seat selectively engaging the flywheel with the reversible engine. The positioning seat releases from the reversible engine when the reversible engine is started. An ignition device is adapted to connect to the reversible engine. The ignition device includes a rotor rotated with the reversible engine. A sense member is mounted on an outer periphery of the rotor and a magnetic sensor is separately mounted near the sense member and corresponding to the sense member. The sense member is adapted to make the magnetic sensor providing an ignition signal to a spark plug that is mounted on the reversible engine when the rotor rotates.

Further benefits and advantages of the present invention will become apparent after a careful reading of the detailed description with appropriate reference to the accompanying drawings.

DETAILED DESCRIPTION OF THE INVENTION

Figure 1:
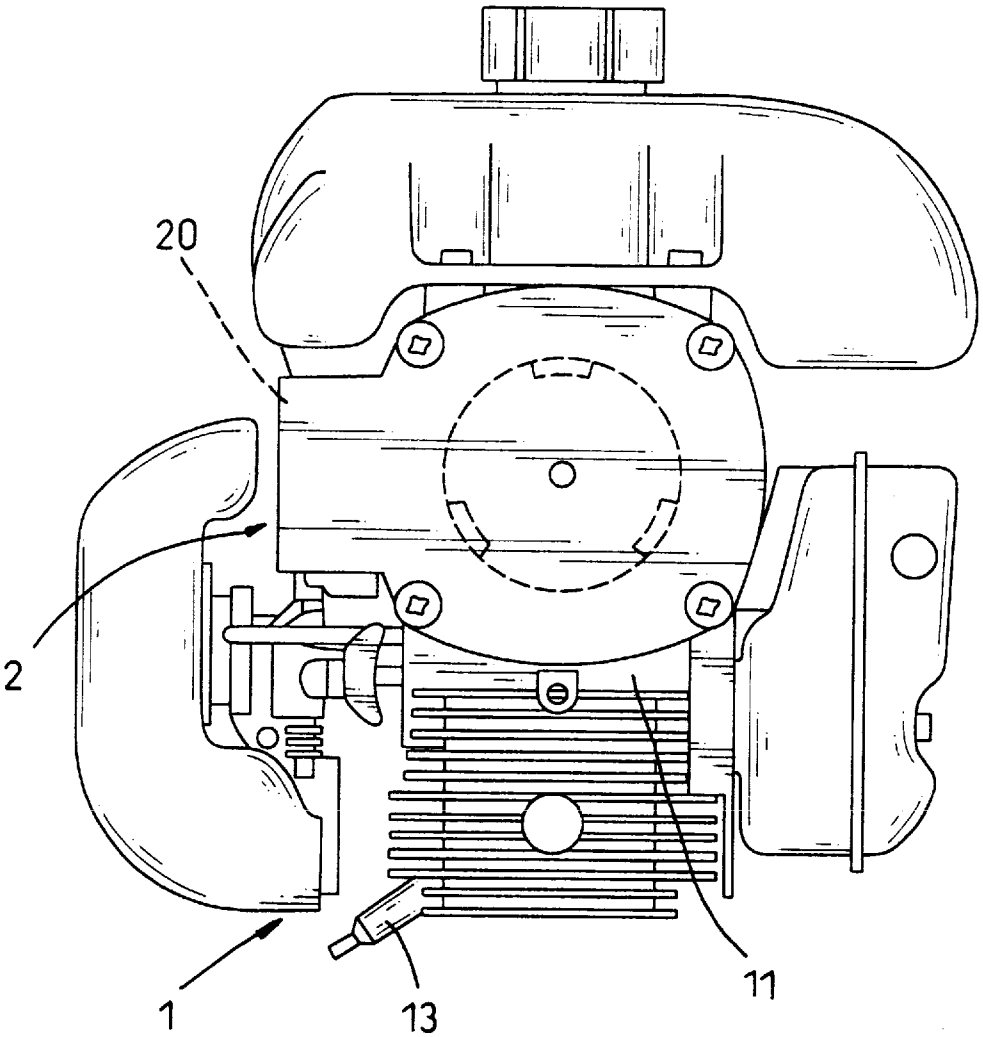
FIG. 1 is a front plan view of an engine starter in accordance with the present invention, which is adapted to mount on a reversible engine.
Figure 2:
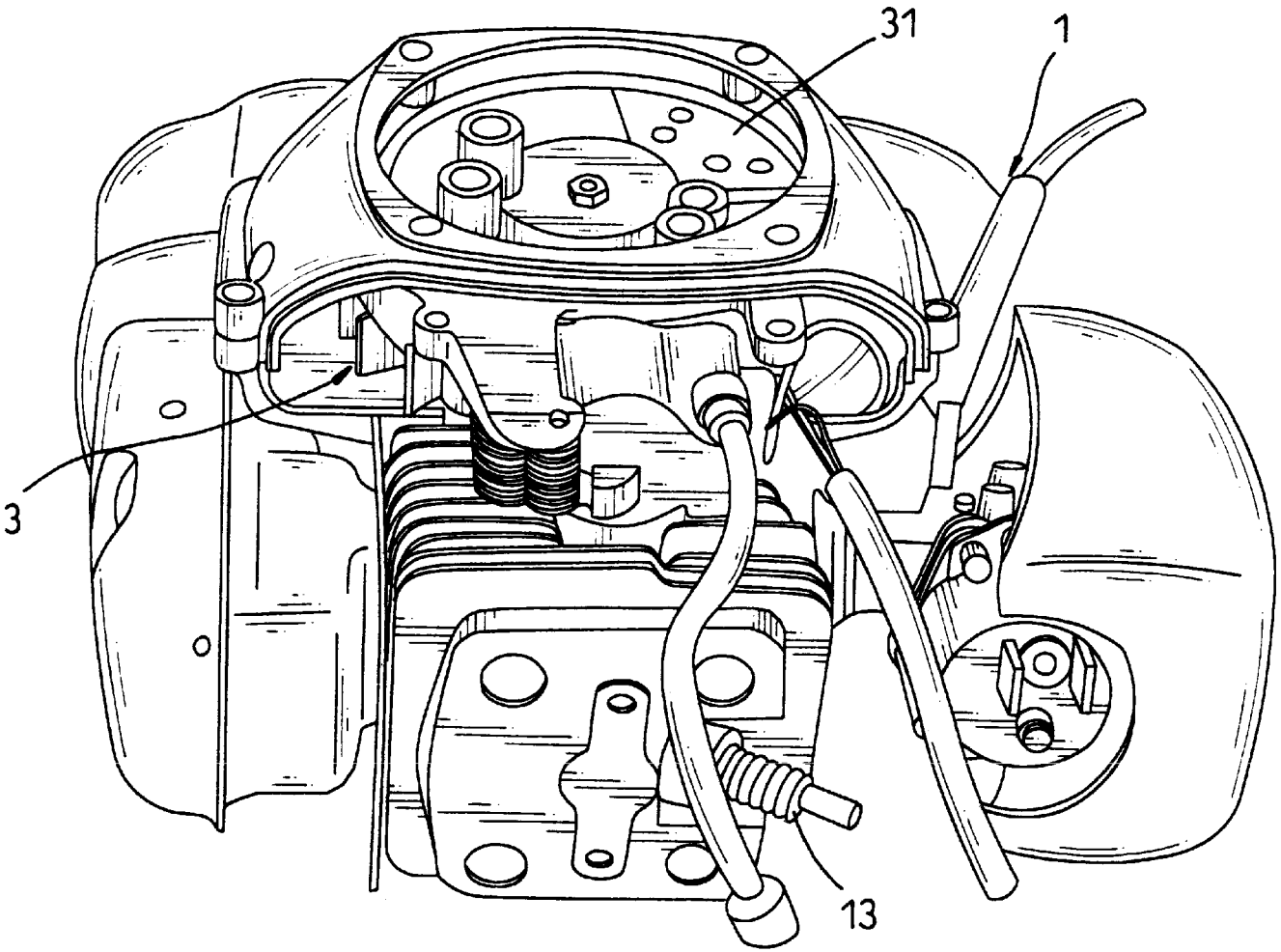
FIG. 2 is a rear perspective view of the reversible engine starter in FIG. 1.

With reference to FIGS. 1 and 2, a engine starter in accordance with the present invention is adapted to mount on a reversible engine with a spark plug (13) and comprises a drive device (2), an ignition device (3) and a control unit (not shown). The control unit is electrically connected to the drive device (2) and the ignition device (3) to control the drive device (2) and the ignition device (3).

The drive device (2) selectively rotates the reversible engine (1) in a normal direction or a reverse direction. The drive device has two modes of operation. One is manual, and the other is operated by a motor (not shown). In the preferred embodiment of the present invention, a motor rotates the drive device (2).

Figure 3:
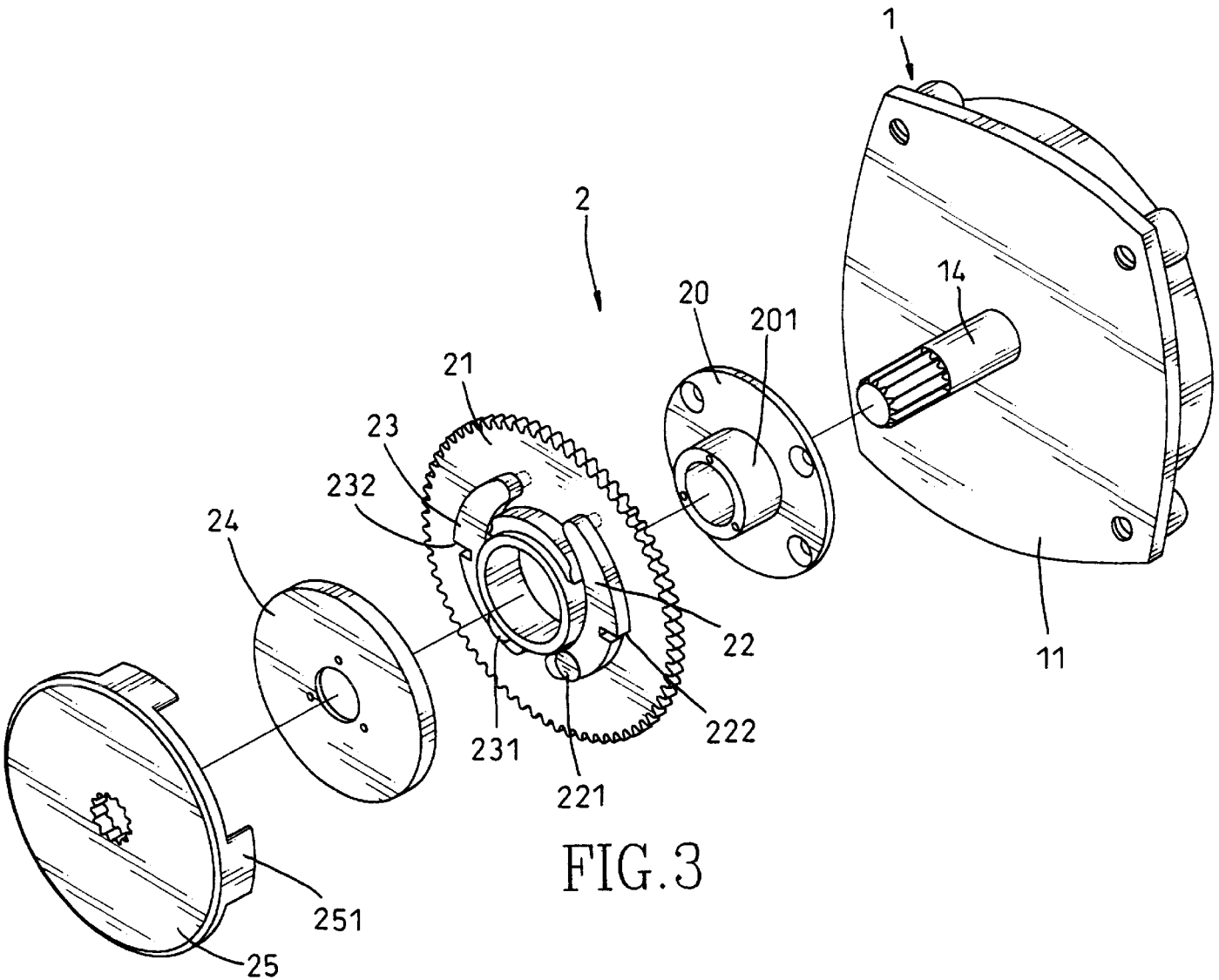
FIG. 3 is an exploded perspective view of a drive device of the engine starter in accordance with the present invention.

With reference to FIG. 3, the drive device (2) comprises a positioning seat (20), a flywheel (21) with a first pawl (22) and a second pawl (23), a positioning plate (24) and a starter wheel (25). The positioning seat (20) is mounted on the casing (11) of the reversible engine (1) or integrally formed on the casing (11) of the reversible engine (1). In the preferred embodiment of the present invention, the positioning seat (20) is mounted on the casing (11) of the reversible engine (1). The positioning seat (20) is disk shaped and has two sides. A sleeve (201) is axially connected to or formed on the side of an the positioning seat (20) opposite to the reversible engine (1). The reversible engine (1) includes a shaft (14) rotatably extending through the sleeve (201) of the positioning seat (20). The flywheel (21) is disk shaped with two sides, an outer periphery, a central hole and a series of teeth (not numbered) formed on an outer periphery. The flywheel (21) is rotatably mounted around the sleeve (201). The teeth are adapted to engage a gear (not shown) that is driven by the motor. Each first pawl (22) and second pawl (23) includes a first end pivotally connected to the side of the flywheel (21) opposite to the reversible engine (1) and a second end having a magnet (221, 231) mounted in the pawl (22, 23). The two pawls (22. 23) correspond to each other and each has a clutch (222, 232) laterally formed near a middle portion of the pawl (22, 23). The positioning plate (24) is made of magnetic material and is mounted on the end of the sleeve (201) after the sleeve (201) extends through the flywheel (211). The starter wheel (25) is disk shaped, has two sides, an outer edge and a keyed central hole, covers the positioning plate (24) and is securely connected to the shaft (14) of the reversible engine (1). Multiple protrusions (251) extend axially from the edge of the starter wheel (25) toward the flywheel (21). The appropriate clutch (222, 232) on one of the pawls (22. 23) depending on the direction of rotation engages one of the protrusions (251) so the starter wheel (25) rotates the shaft (14) of the reversible engine (1) when the motor rotates the flywheel (21).

Figure 4:
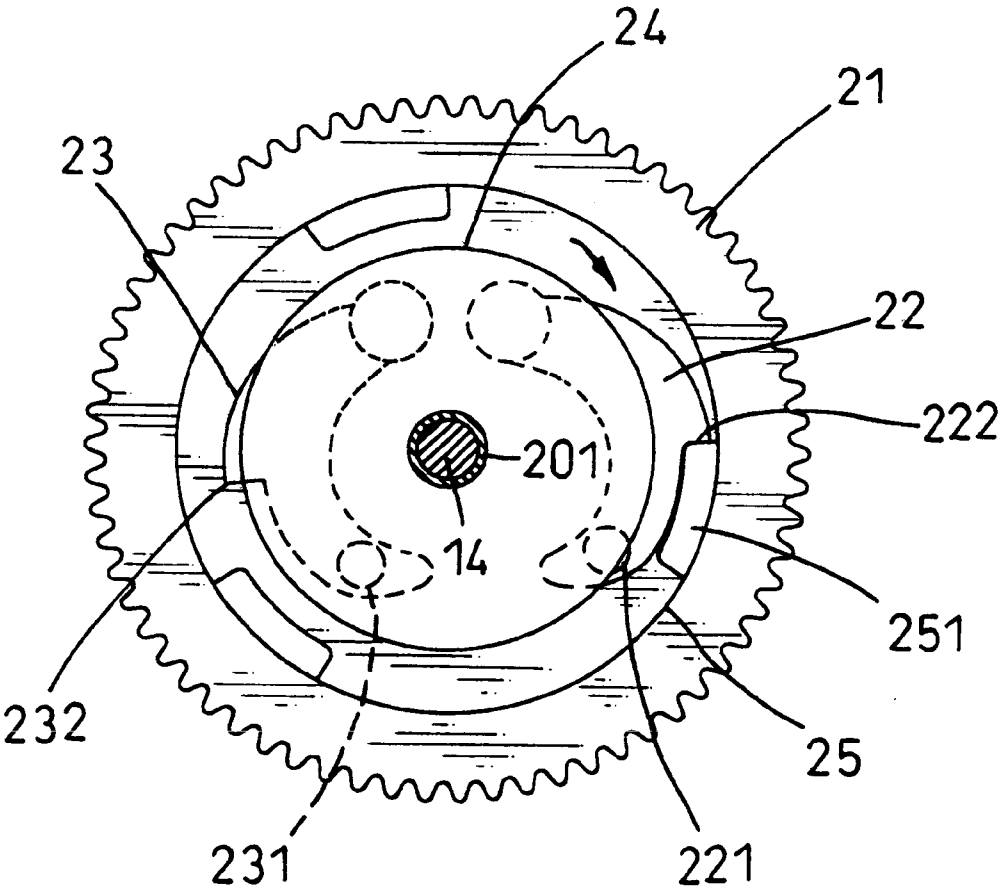
FIG. 4 is an operational plan view of a flywheel of the drive device in FIG. 3.

The engine starter is operated by selectively engaging one of the two pawls (22, 23) with the protrusion (25 1) on the starter wheel (25). The pawl (22, 23) selected is determined by the direction in which the flywheel (21) rotates and the resultant centrifugal force acting on the pawls (22, 23). With reference to FIG. 4, for example, the clutch (222) of the first pawl (22) engage a protrusion (251) when the flywheel (21) is rotated clockwise by the motor. When the reversible engine starts, the protrusion (251) securely attached to the shaft (14) of the engine quickly accelerates and rotates faster than that of the flywheel (21). The protrusion (251) separates from the first pawl (22), and the first pawl (22) is push back by the next protrusion (251) on the starter wheel (25).

Figure 5:
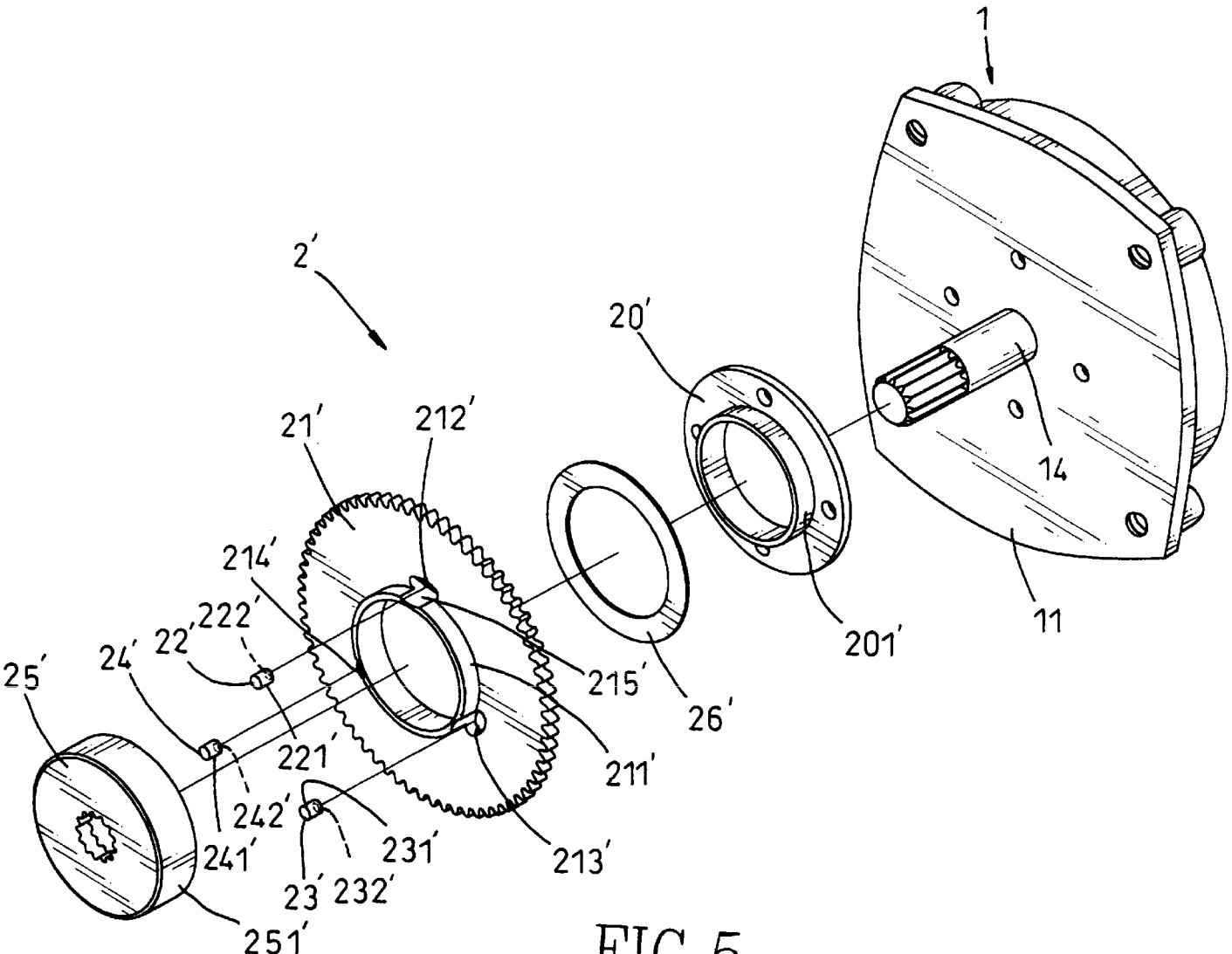
FIG. 5 is an exploded perspective view of another embodiment of the drive device in accordance with the present invention.

With reference to FIG. 5, another embodiment of the drive device (2') in accordance with the present invention comprises a positioning seat (20'), a flywheel (21'). a starter wheel (25') and a washer (26') that is made of magnetic material. The positioning seat (20') is mounted on the casing (11) of the reversible engine (1) or integrally formed on the casing (11) of the reversible engine (1). The positioning seat (20') is disk shaped and has two sides. A sleeve (201') is axially connected to or formed on the side of the positioning seat (20') opposite to the reversible engine (1). The washer (26') is mounted around the sleeve (201') on the positioning seat (20'), and the flywheel (2 ') is mounted around the sleeve (201') to hold the washer (26') in place. The flywheel (21') includes an opening (not numbered) defined to rotatably receive the sleeve (201') of the positioning seat (20') and a collar (211') extending from the inner periphery of the opening away from the reversible engine (1). Multiple elliptical through holes (212', 213', 214') are defined in the flywheel (21') near the collar (211'). Multiple rods (22', 23', 24') are respectively movably received in corresponding through holes (212', 213', 214'). One end of each rod (22', 23', 24') has a magnet (222', 232', 242') secured in the rod (22', 23', 24') so that the rods (22', 23', 24') remain perpendicular to the washer (26'). The starter wheel (25') is securely attached to the shaft (14) of the reversible engine (1) and has a skirt (251') extending from a periphery of the starter wheel (25'). The starter wheel (25') covers the collar (211') and receives the rods (22', 23', 24') so that the rods (22', 23', 24') selectively abut the inner periphery of the skirt (251') to drive the starter wheel (25') when the flywheel (21') is driven by a motor.

Figure 6:
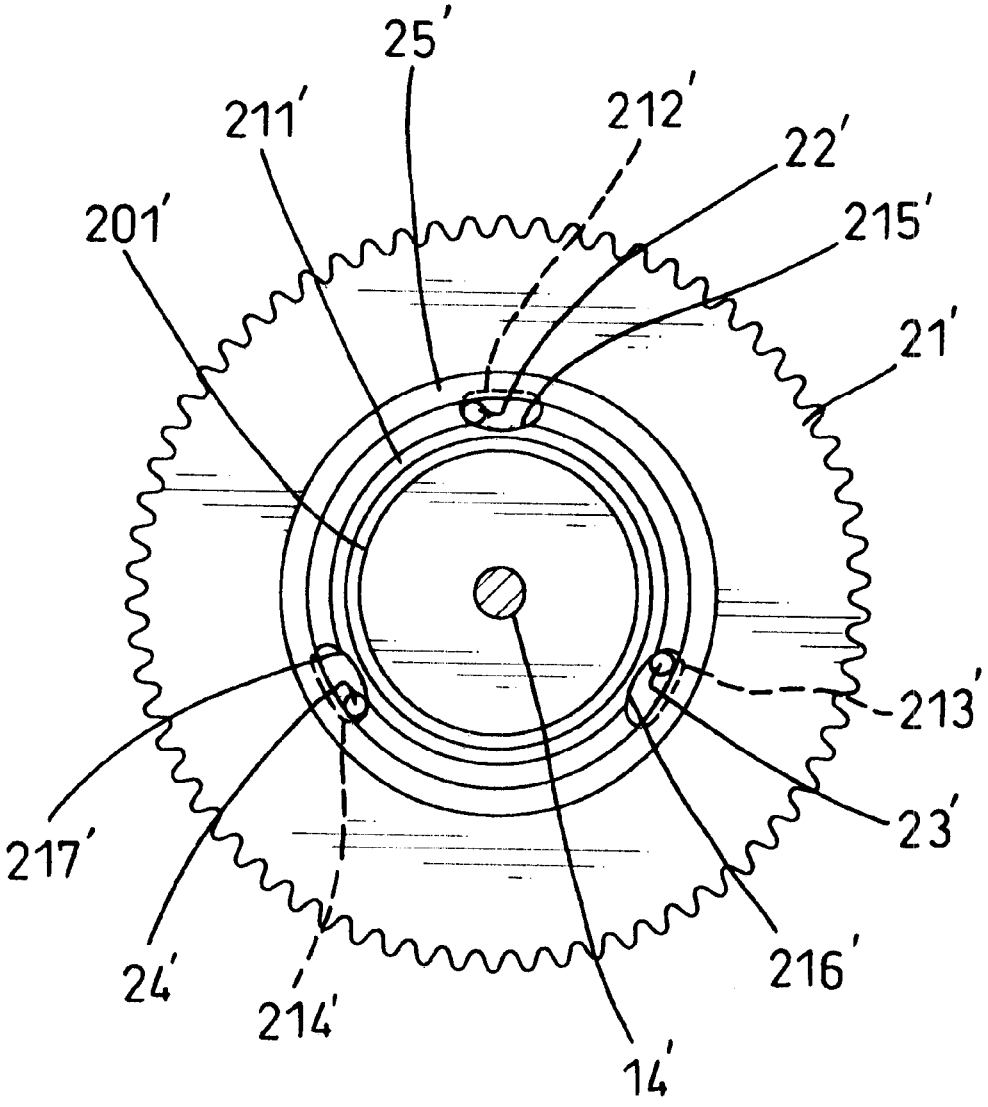
FIG. 6 is an operational front plan view of a flywheel of the drive device in FIG. 5.

With reference to FIG. 6, the engine starter is operated by selectively rotating the (21') in a desired direction by the motor. The rods (22', 23', 24') move toward the trailing edge of the elliptical through holes (212', 213', 214') and are forced outwardly by the edge of the elliptical through holes (212', 213', 214'). The rods (22', 23', 24') are squeezed between the edges of the elliptical through holes (212', 213', 214') and the inner periphery of the skirt (251') of the starter wheel (25'), which causes the starter wheel (25') to rotate with the flywheel (21') and start the reversible engine (1'). When the reversible engine (1) starts, the shaft (14) and attached starter wheel (25') quickly accelerate and release the rods (22', 23', 24').

Figure 7:
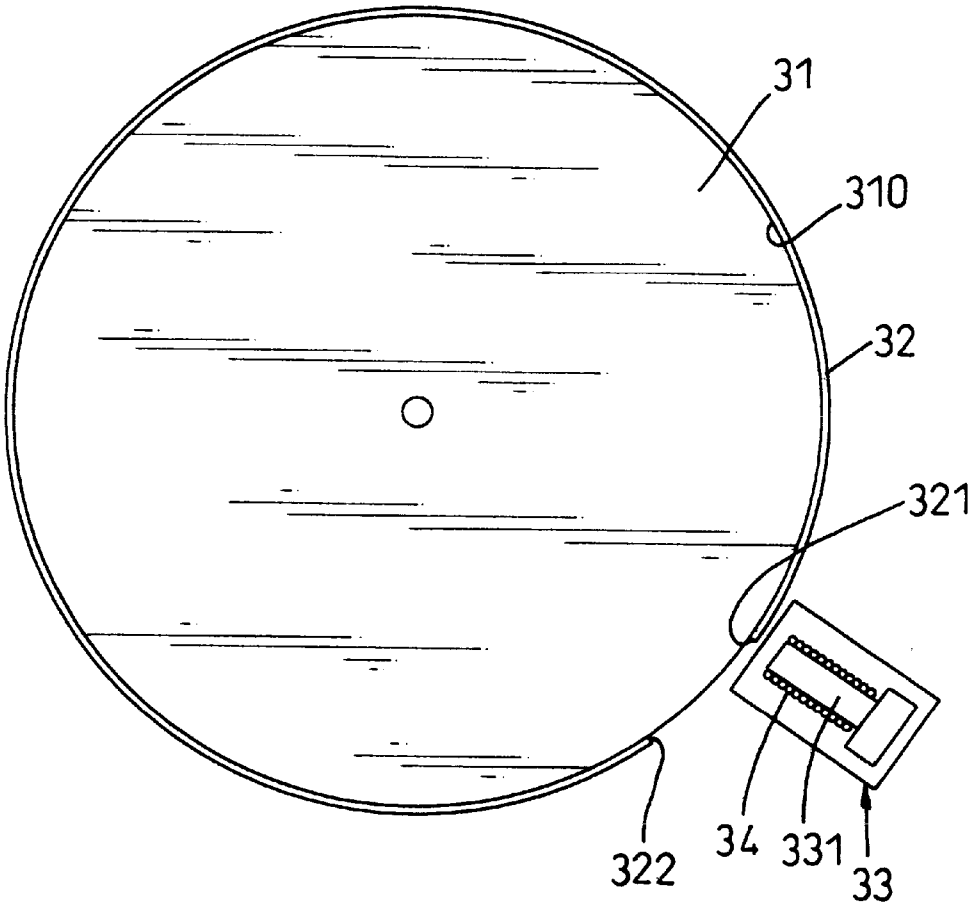
FIG. 7 is a front plan view of an ignition device in accordance with the present invention.
Figure 8:
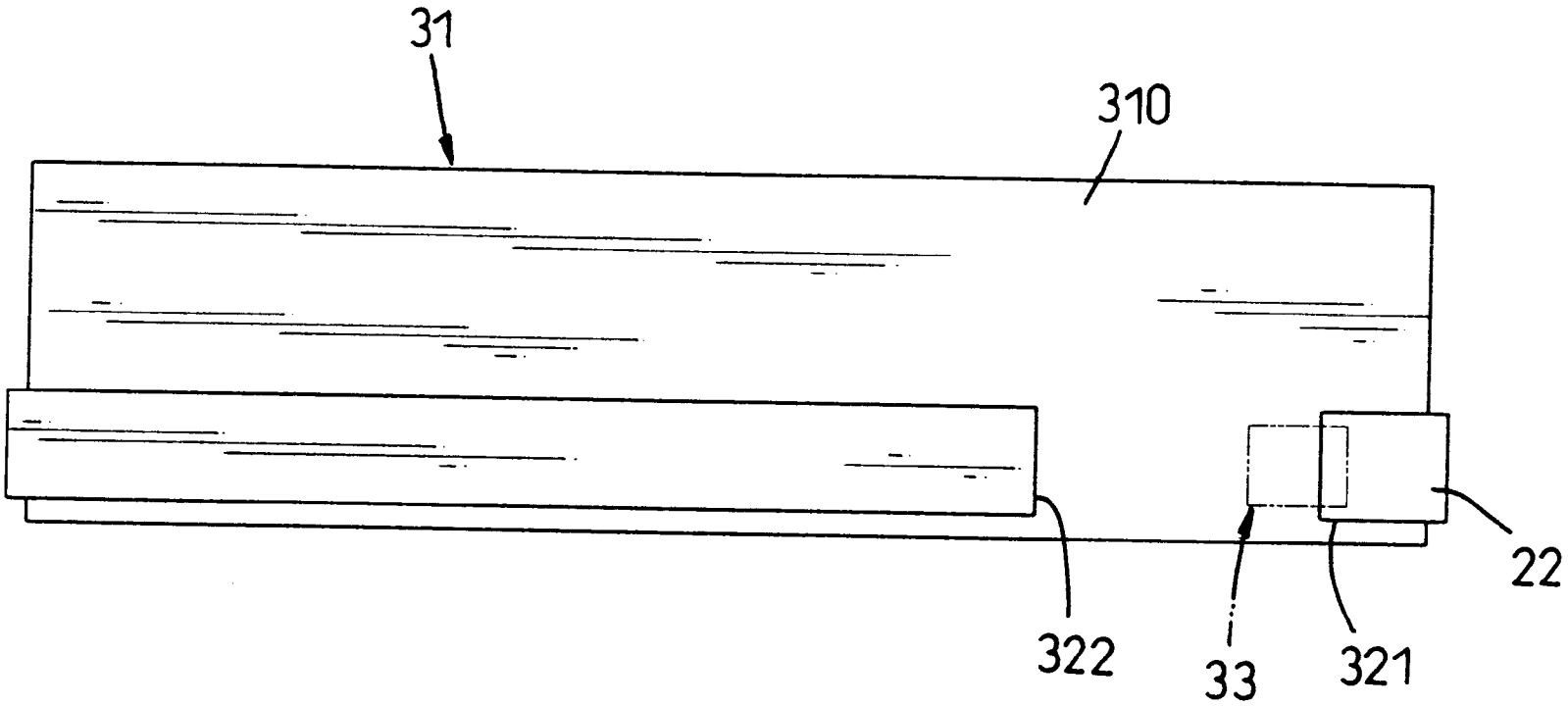
FIG. 8 is a side plan view of an ignition coil of the ignition device in FIG. 7.

With reference to FIGS. 2, 7 and 8, the ignition device (3) comprises a rotor (31) rotated with the reversible engine (1) and a sense member (32) mounted on an outer peripheral (310) of the rotor (31). The rotor (31) can be an axle or a wheel. A magnetic sensor (33) is separately mounted in close proximity to the sense member (32) and corresponds to the sense member (32). The magnetic sensor (33) includes a magnetic rod (331) and a coil (34) mounted around the magnetic rod (331). The sense member (32) has two ends (321, 322) separated from and facing each other. The two separate ends (321, 322) of the sense member (32) make the magnetic sensor (33) providing an ignition signal to the spark plug (13) when the rotor (31) rotates.

Figure 9:
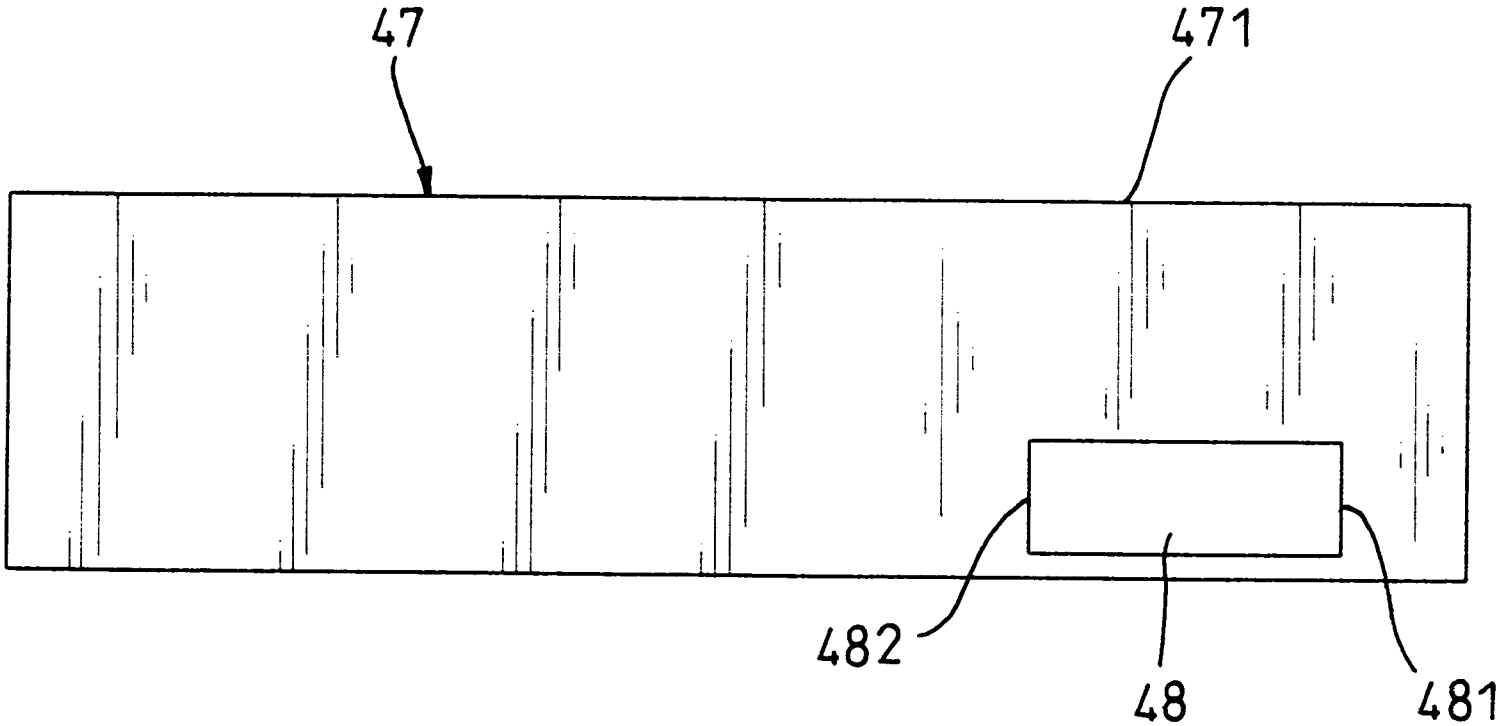
FIG. 9 is a side plan view of a second embodiment of the ignition coil of the ignition device in FIG. 7.

With reference to FIG. 9, a second embodiment of the ignition device (3) in accordance with the present invention has a rotor (47) with an outer periphery (471) that is made of magnetic material. A non-magnetic gap (48) is defined in the outer periphery (471) and corresponds to the shape of the rotor (47). The non-magnetic gap (48) has two opposite ends (481, 482) that make the magnetic sensor (33) providing an ignition signal to the spark plug (13) when the rotor (47) rotates.

Figure 10:
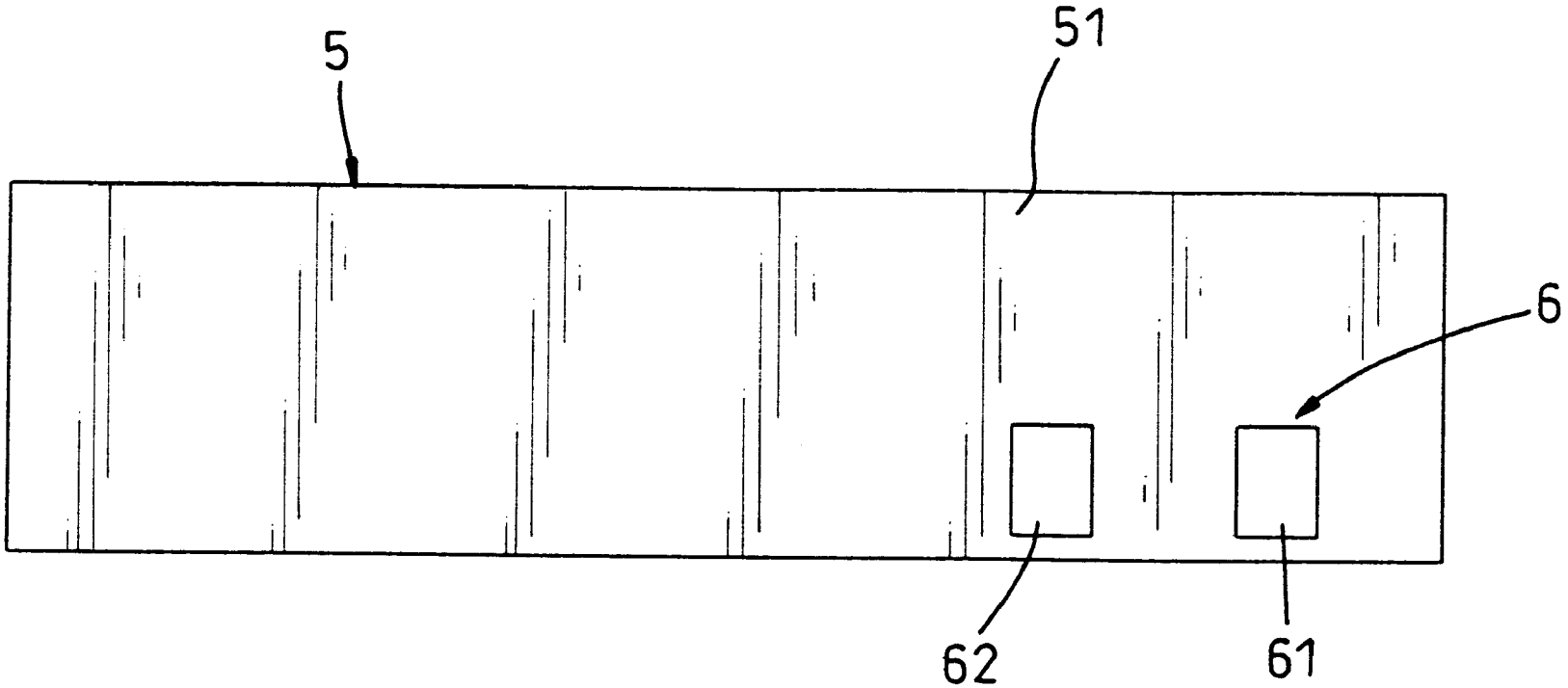
FIG. 10 is a side plan view of a third embodiment of the ignition coil of the ignition device in FIG. 7.

With reference to FIG. 10. a third embodiment of the ignition device (3) in accordance with the present invention has a sense member (6) with two sense plates (61, 62) separately mounted on an outer periphery (51) of the rotor (5). The two sense plates (61, 62) align with each other and make the magnetic sensor (33) providing an ignition signal to the spark plug (13) when the rotor (5) rotates.

Figure 11:
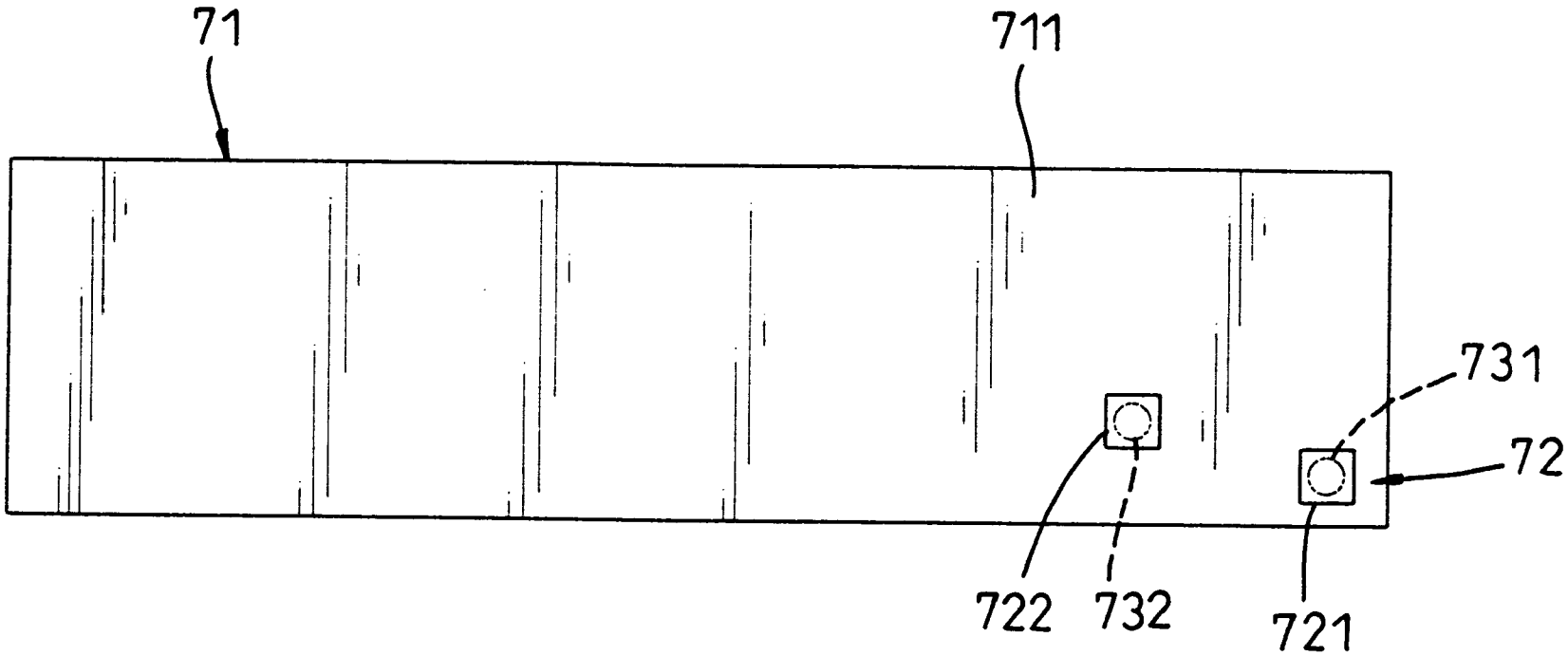
FIG. 11 is a side plan view of a fourth embodiment of the ignition coil of the ignition device in FIG. 7.

With reference to FIG. 11. a fourth embodiment of the ignition device (3) in accordance with the present invention has a two-part sense member (72) that includes two magnetic sense plates (721, 722) respectively mounted to an outer periphery (711) of the rotor (71) with a magnetic element (731, 732). A height difference is formed between the two magnetic sense plates (721, 722) so that the two magnetic sense plates (721, 722) is selected to make the magnetic sensor (33) providing an ignition signal to the spark plug (13) when the rotor (5) rotates in a normal operation or a reversing operation.

Although the invention has been explained in relation to its preferred embodiment it is to be understood that many other possible modifications and variations can be made without departing from the spirit and scope of the invention as hereinafter claimed.

What is claimed is:

1. An engine starter for a reversible engine comprising:

a drive device adapted to rotatably mount on a reversible engine, the drive device including a flywheel adapted to connect to a motor and a positioning seat selectively connecting the flywheel to the reversible engine, the positioning seat being released from the reversible engine when the reversible engine is started; and an ignition device adapted to connect to the reversible engine, the ignition device including a rotor rotated with the reversible engine, a sense member mounted on an outer periphery of the rotor and a magnetic sensor separately mounted in close proximity to the sense member and corresponding to the sense member, the sense member adapted to make the magnetic sensor providing an ignition signal to a spark plug that is mounted on the reversible engine when the rotor rotates;

wherein the drive device further comprises a starter wheel selectively engaged to the flywheel and adapted to drive the reversible engine and the starter wheel including a skirt extending from a periphery of the starter wheel and directing to the flywheel;

the positioning seat includes a sleeve centrally extending from the positioning seat;

the flywheel is mounted on the sleeve of the positioning seat and includes:

an opening centrally defined to rotatably receive the sleeve of the positioning seat;

multiple elliptical through holes defined in the flywheel; and multiple rods respectively movably received in corresponding elliptical through holes, each rod selectively abuts an inner periphery of the skirt to drive the starter wheel when the flywheel rotates.

2. An engine starter for a reversible engine comprising:

a drive device adapted to rotatably mount on a reversible engine, the drive device including a flywheel adapted to connect to a motor and a positioning seat selectively connecting the flywheel to the reversible engine, the positioning seat being released from the reversible engine when the reversible engine is started; and an ignition device adapted to connect to the reversible engine, the ignition device including a rotor rotated with the reversible engine, a sense member mounted on an outer periphery of the rotor and a magnetic sensor separately mounted in close proximity to the sense member and corresponding to the sense member, the sense member adapted to make the magnetic sensor providing an ignition signal to a spark plug that is mounted on the reversible engine when the rotor rotates;

wherein the drive device further comprises a starter wheel selectively engaged to the flywheel and adapted to drive the reversible engine and a washer mounted between the positioning seat and the flywheel, the washer being made of magnetic material, and the starter wheel including a skirt extending from a periphery of the starter wheel and directing to the flywheel;

wherein the positioning seat includes a sleeve centrally extending from the positioning seat and extending through the washer;

wherein the flywheel is mounted on the sleeve of the positioning seat to hold the washer in place and further includes:

an opening centrally defined to rotatably receive the sleeve of the positioning seat;

a collar extending from a periphery of the opening opposite to the positioning seat and covered within the skirt of the starter wheel;

multiple elliptical through holes defined in the flywheel near the collar; and multiple rods respectively movably received in corresponding elliptical through holes, each rod including one end having a magnet secured in the rod so that the rods stand on the washer and selectively abut an inner periphery of the skirt to drive the starter wheel when the flywheel rotates.

* * * * *